US011134753B2

(12) United States Patent
Yang et al.

(10) Patent No.: US 11,134,753 B2
(45) Date of Patent: Oct. 5, 2021

(54) AUTOMATIC LACING MECHANISM

(71) Applicant: IDEA (MACAO COMMERCIAL OFFSHORE) LIMITED, Macau (CN)

(72) Inventors: Chang-Chen Yang, Taichung (TW); Po-Chih Lin, Changhua (TW); Chun-Hsien Ou, Magong (TW)

(73) Assignee: IDEA (MACAO COMMERCIAL OFFSHORE) LIMITED, Macau (CN)

( * ) Notice: Subject to any disclaimer, the term of this patent is extended or adjusted under 35 U.S.C. 154(b) by 157 days.

(21) Appl. No.: 16/725,798

(22) Filed: Dec. 23, 2019

(65) Prior Publication Data

US 2020/0196711 A1 Jun. 25, 2020

(30) Foreign Application Priority Data

Dec. 24, 2018 (TW) ..... 107217540

(51) Int. Cl.
*A43D 11/00* (2006.01)
*A43D 11/08* (2006.01)

(52) U.S. Cl.
CPC ..... *A43D 11/085* (2013.01); *A43D 11/00* (2013.01)

(58) Field of Classification Search
CPC ..... A43D 11/00; A43D 11/08; A43D 11/085; A43D 2200/10
USPC ..... 12/58.5, 142 LC
See application file for complete search history.

(56) References Cited

FOREIGN PATENT DOCUMENTS

| | | |
|---|---|---|
| TW | I543717 B | 8/2016 |
| TW | I581731 B | 5/2017 |

OTHER PUBLICATIONS

English Abstract for TWI543717, Total of 1 page.
English Abstract for TWI581731, Total of 1 page.

*Primary Examiner* — Khoa D Huynh
*Assistant Examiner* — Aiying Zhao
(74) *Attorney, Agent, or Firm* — Tracy M Heims; Apex Juris, pllc.

(57) ABSTRACT

An automatic lacing mechanism automatically laces between two shoe pieces, and includes a clamping module, a positioning module, a shoelace-running module, and a shoelace-arranging module. The clamping module is adapted to fixedly clamp shoe pieces. The positioning module is adapted to position the shoe pieces prior to the shoe pieces are fixedly clamped, so that the clamping module could firmly clamp the shoe pieces. The shoelace-running module is adapted to run the shoelace through the lace eyelets on the shoe pieces. The shoelace-arranging module is adapted to change the direction of the shoelace during lacing. The positioning module has two positioning pins, wherein a distance therebetween is adjustable, and therefore the positioning module is suitable for the positioning of footwear having different distances between its lace eyelets, which could make the automatic lacing process smoother.

7 Claims, 10 Drawing Sheets

AUTOMATIC LACING MECHANISM

BACKGROUND OF THE INVENTION

1. Technical Field

The present invention relates generally to shoemaking equipment, and more particularly to an automatic lacing mechanism which could automatically run a shoelace through lace eyelets of a shoe during the making of the shoe.

2. Description of Related Art

Conventional footwear usually needs to have the shoelace run through the lace eyelets before leaving the factory. Such process is troublesome, for the upper of footwear has to be soft and breathable, and therefore is commonly made of fabric or leather. There is another type of footwear that provides lace eyelets on thin shoe pieces in advance, and the shoe pieces are combined with fabric or leather to form differently novel shoe uppers. However, no matter how an upper is made, manual lacing always has low efficiency, which inevitably affects the production capacity.

Some manufacturers in the industry have developed automatic lacing machines, such as Taiwanese invention patent No. I581731, titled "Method and device of automatic lacing", and Taiwanese invention patent No. I543717, titled "automatic lacing machine". The objectives of these inventions are both to replace manual work by automation. However, the aforementioned patents fail to explicitly disclose how to keep an upper stable for the lacing process performed by an automation machine. Though automatic lacing equipment which is currently available has some design to firmly fix an upper, there is still no specific technical disclosure on how to deal with the problem that the distance between two successive lace eyelets may be different in different footwear specifications. Said problem is particularly critical when lacing through lace eyelets on shoe pieces of different specifications. Therefore, the currently available automatic lacing machines still have room for efficiency improvement.

BRIEF SUMMARY OF THE INVENTION

In view of the above, the objective of the present invention is to provide an automatic lacing mechanism, which could keep a shoe upper steady for automatic lacing process, and would be suitable for various specifications of footwear regardless of how the distance between two successive lace eyelets varies.

The present invention provides an automatic lacing mechanism for automatically lacing a shoelace between two shoe pieces. The automatic lacing mechanism includes a positioning module, a clamping module, a shoelace-running module, and a shoelace-arranging module. The positioning module includes a first moving unit and two positioning pins, wherein the first moving unit is adapted to move the positioning pins in and out of two lace eyelets on one of the shoe pieces, and a distance between the positioning pins is adjustable. The clamping module includes a fixed plate and a movable plate, wherein the movable plate is operable to approach or leave the fixed plate. When the movable plate approaches the fixed plate, the clamping module is adapted to fixedly clamp one of the shoe pieces; when the movable plate is away from the fixed plate, the clamping module is adapted to release said shoe piece. Furthermore, the positioning pins of the positioning module exits the lace eyelets when said shoe piece is clamped. The shoelace-running module is adapted to run the shoelace through the lace eyelets of the shoe pieces. The shoelace-arranging module is adapted to change a running direction of the shoelace.

In an embodiment, the automatic lacing mechanism further includes a controller, which is adapted to be used to input parameters to automatically adjust the distance between the positioning pins of the positioning module.

In an embodiment, the positioning module comprises a casing, a power source, and a sliding block; the casing is provided with a chute on a lateral side thereof; the power source and the controller are electrically connected; the sliding block is disposed in the casing, and is drivable by the power source to rectilinearly reciprocate; a part of the sliding block passes through the chute and protrudes outside to link one of the positioning pins.

In an embodiment, the first moving unit includes a first cylinder and a first sliding seat. The first cylinder has a first retractable rod which is movable relative to a cylinder body of the first cylinder. The first sliding seat is movably engaged to an external of the first cylinder. An end of the first retractable rod is connected to the first sliding seat. The casing is engaged onto the first sliding seat. The other one of the positioning pins of the positioning module is fixed at the casing or the first sliding seat.

In an embodiment, the clamping module includes a second moving unit, which includes a second cylinder and a second sliding seat. The second cylinder has a second retractable rod which is movable relative to a cylinder body of the second cylinder. The second sliding seat is movably engaged to an external of the second cylinder, and an end of the second sliding seat is connected to the movable plate. An end of the second retractable rod is connected to the second sliding seat. The first cylinder is engaged onto the second sliding seat.

In an embodiment, the fixed plate and the movable plate of the clamping module have a plurality of hollow portions formed on upper parts thereof, and a pressing sheet is formed beside the hollow portions. When said shoe piece is fixedly clamped between the fixed plate and the movable plate, the lace eyelets of said shoe piece are aligned with the hollow portions, and the pressing sheet pushes against said shoe piece without covering the lace eyelets thereof.

In an embodiment, the shoelace-running module includes an X-axis module, a Y-axis module, a Z-axis module, and a gripping unit. The Y-axis module is engaged to the X-axis module and is movable in an X-axis direction. The Z-axis module is engaged to the Y-axis module and is movable in a Y-axis direction. The gripping unit is engaged to the Z-axis module and is movable in a Z-axis direction. The gripping unit has a claw to grip an aglet of the shoelace.

With the above-mentioned design, the automatic lacing mechanism could be used for footwear with different distances between its lace eyelets by automatically adjusting the distance between the positioning pins. Furthermore, the clamping module could be utilized to steady an upper for automatic lacing process.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
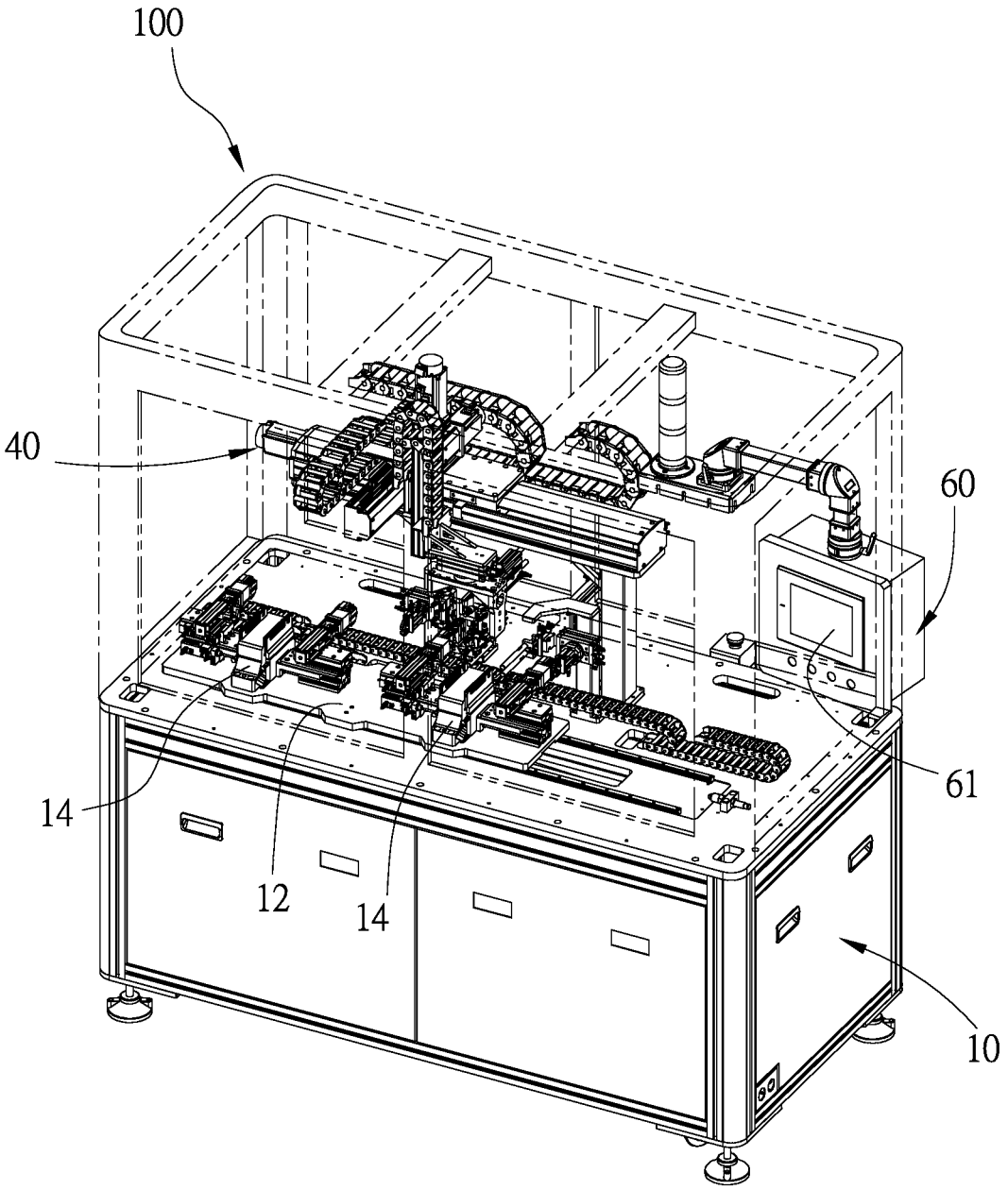
FIG. 1 is a perspective view of the automatic lacing mechanism of a first embodiment of the present invention.
Figure 2:
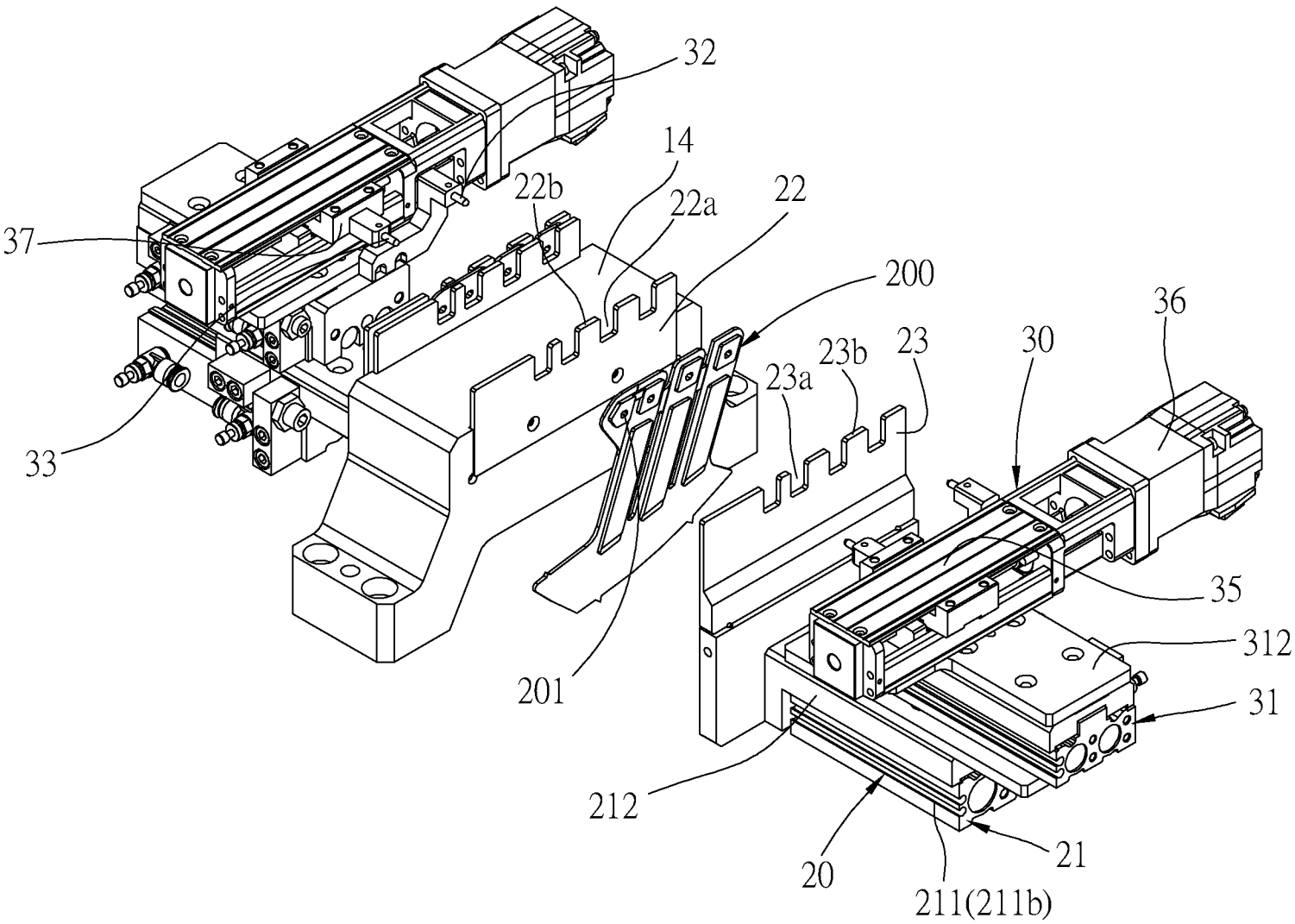
FIG. 2 is a perspective view of the clamping module and the positioning module of the automatic lacing mechanism shown in FIG. 1.
Figure 3:
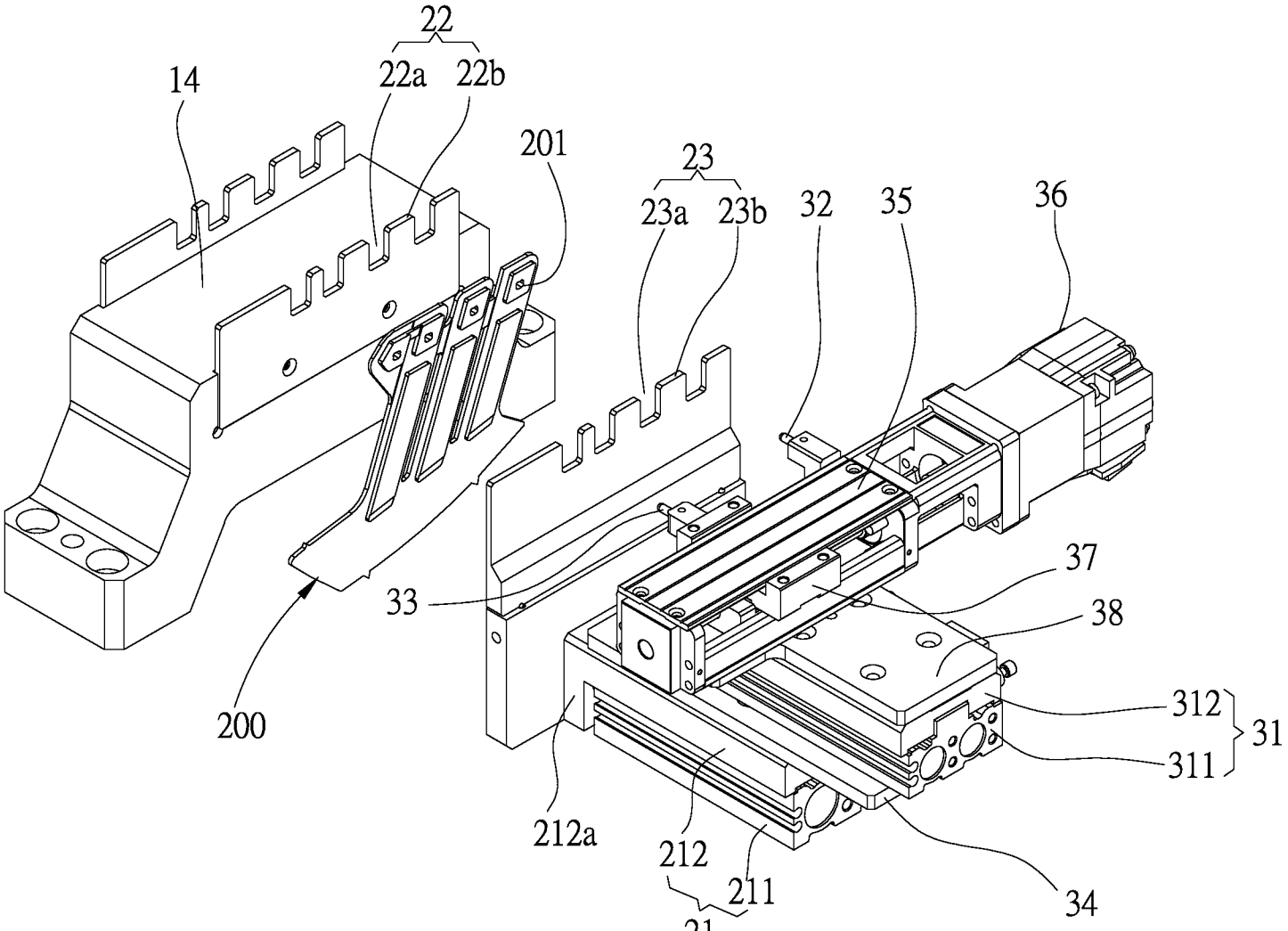
FIG. 3 is an enlarged partial view of FIG. 2.
Figure 4:
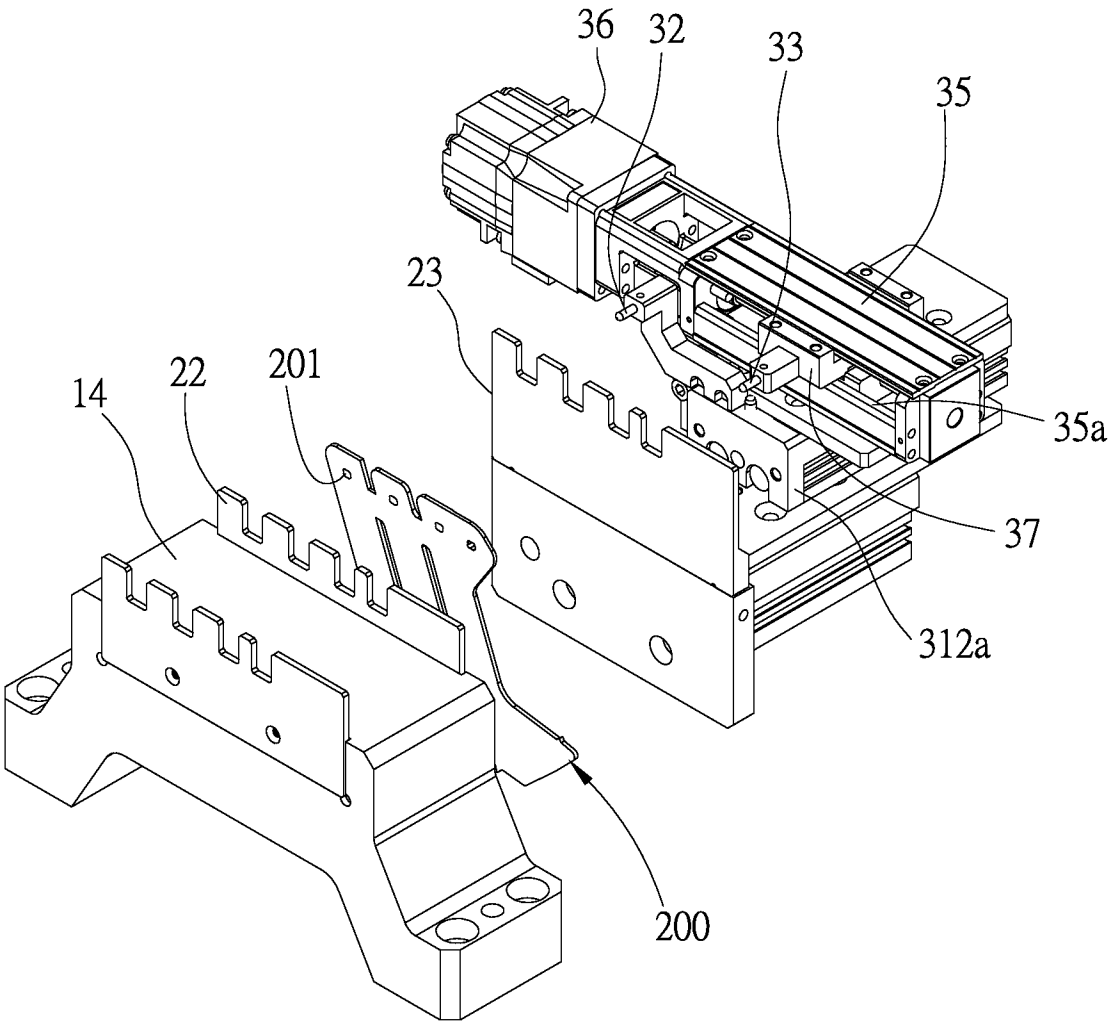
FIG. 4 is a perspective view of the structure shown in FIG. 3 seen from another viewpoint.

An automatic lacing mechanism 100 of an embodiment of the present invention is shown in FIG. 1 to FIG. 6, which could be used to automatically run a shoelace (not shown) through lace eyelets of footwear. In the current embodiment, it is a shoelace passing through lace eyelets 201 of one type of shoe piece 200 as an example. The automatic lacing mechanism 100 includes a base 10, a clamping module 20, a positioning module 30, a shoelace-running module 40, a shoelace-arranging module 50, and a controller 60. The clamping module 20 is adapted to fixedly secure the shoe piece 200. The positioning module 30 is adapted to position the shoe piece 200 in advance prior to the shoe piece 200 is fixed, so that the clamping module 20 could firmly clamp the shoe piece 200. The shoelace-running module 40 is adapted to run the shoelace through the lace eyelets 201 of the shoe piece 200. As for the shoelace-arranging module 50, it is adapted to change a running direction of the shoelace during the lacing.

The aforementioned base 10 is provided with a sliding platform 12 on a top thereof, wherein a position of the sliding platform 12 could be adjusted in a horizontal direction. The clamping module 20 and the positioning module 30 are installed on the sliding platform 12, and therefore their position could be changed along with the sliding platform 12. The shoelace-running module 40 and the shoelace-arranging module 50 are fixedly provided on the top of the base 10. The controller 60 includes a control interface 61 and a central processing unit (not shown). The sliding platform 12 is provided with two retaining brackets 14 thereon. There is a set of a clamping module 20 and a positioning module 30 respectively provided on two sides of each of the retaining brackets 14. For ease of interpretation, we hereinafter take one set of the clamping module 20 and the positioning module 30 as an example.

As shown in FIG. 2 to FIG. 4 and FIG. 8 as well, the clamping module 20 includes a second moving unit 21, a fixed plate 22 and a movable plate 23. The second moving unit 21 includes a second cylinder 211 and a second sliding seat 212, wherein the second cylinder 211 is fixed on the sliding platform 12, and has a second retractable rod 211*a* which is movable relative to a cylinder body 211*b* of the second cylinder 211. The second sliding seat 212 is engaged to an external top surface of the second cylinder 211, and matches the second cylinder 211 in a manner of forming a sliding pair. In other words, one of the second cylinder 211 and the second sliding seat 212 has a chute, and the other one has a sliding block matching the chute. The second sliding seat 212 has a second front end portion 212*a* to be linked to an end of the second retractable rod 211*a*. When the second retractable rod 211*a* is driven by a pressure source to move back and forth, the second sliding seat 212 is also synchronously moved. The aforementioned pressure source could be pneumatic or hydraulic.

In addition, the fixed plate 22 of the clamping module 20 is engaged to a lateral side of the corresponding retaining bracket 14, and the movable plate 23 is engaged to an outside of the second front end portion 212*a* of the second sliding seat 212. Furthermore, the fixed plate 22 and the movable plate 23 respectively have a plurality of corresponding hollow portions 22*a*, 23*a* formed on upper parts thereof. A pressing sheet 22*b*, 23*b* is formed beside a hollow portion or between two adjacent hollow portions. When the second sliding seat 212 is driven by the second retractable rod 211*a* to move back and forth, the movable plate 23 consequently approaches or leaves from the fixed plate 22.

The positioning module 30 is engaged onto the second sliding seat 212 of the second moving unit 21, and is located on a side of the movable plate 23 other than the side that the fixed plate 22 is located. The positioning module 30 includes a first moving unit 31 and two positioning pins, wherein said two positioning pins include a first positioning pin 32 and a second positioning pin 33. The first moving unit 31 includes a first cylinder 311 and a first sliding seat 312, wherein the first cylinder 311 is fixedly engaged to a top of the second sliding seat 212 through an engaging board 34. The first cylinder 311 has a first retractable rod 311*a* which is movable relative to a cylinder body 311*b* of the first cylinder 311. The first sliding seat 312 is engaged to an external top surface of the first cylinder 311, and match the first cylinder 311 in a manner of forming a sliding pair. In other words, one of the first cylinder 311 and the first sliding seat 312 has a chute, while the other one has a sliding block matching the chute. The first sliding seat 312 has a first front end portion 312*a* to be linked to an end of the first retractable rod 311*a*. When the first retractable rod 311*a* is driven by a pressure source to move back and forth, the first sliding seat 312 is also synchronously moved. The aforementioned pressure source could be pneumatic or hydraulic.

The positioning module 30 of the current embodiment further includes a casing 35, a power source, which is a motor 36 as an example, and a sliding block 37. The casing 35 is fixedly engaged onto the first sliding seat 312 through an engaging board 38. The casing 35 has a chute 35*a* provided on a lateral side thereof. The first positioning pin 32 is optional to be fixed on the casing 35, the engaging board 38, or the first sliding seat 312. In the current embodiment, the first positioning pin 32 is fixed on the engaging board 38. The motor 36 is provided on a side of the casing 35, and is electrically connected to the controller 60. The sliding block 37 is provided in the casing 35, and is drivable by the motor 36 to rectilinearly reciprocate. A part of the sliding block 37 passes through the chute 35*a* to protrude outside, and is connected to the second positioning pin 33, so that the second positioning pin 33 is movable along with the sliding block 37, and therefore changes a distance between it and the first positioning pin 32.

Figure 5:
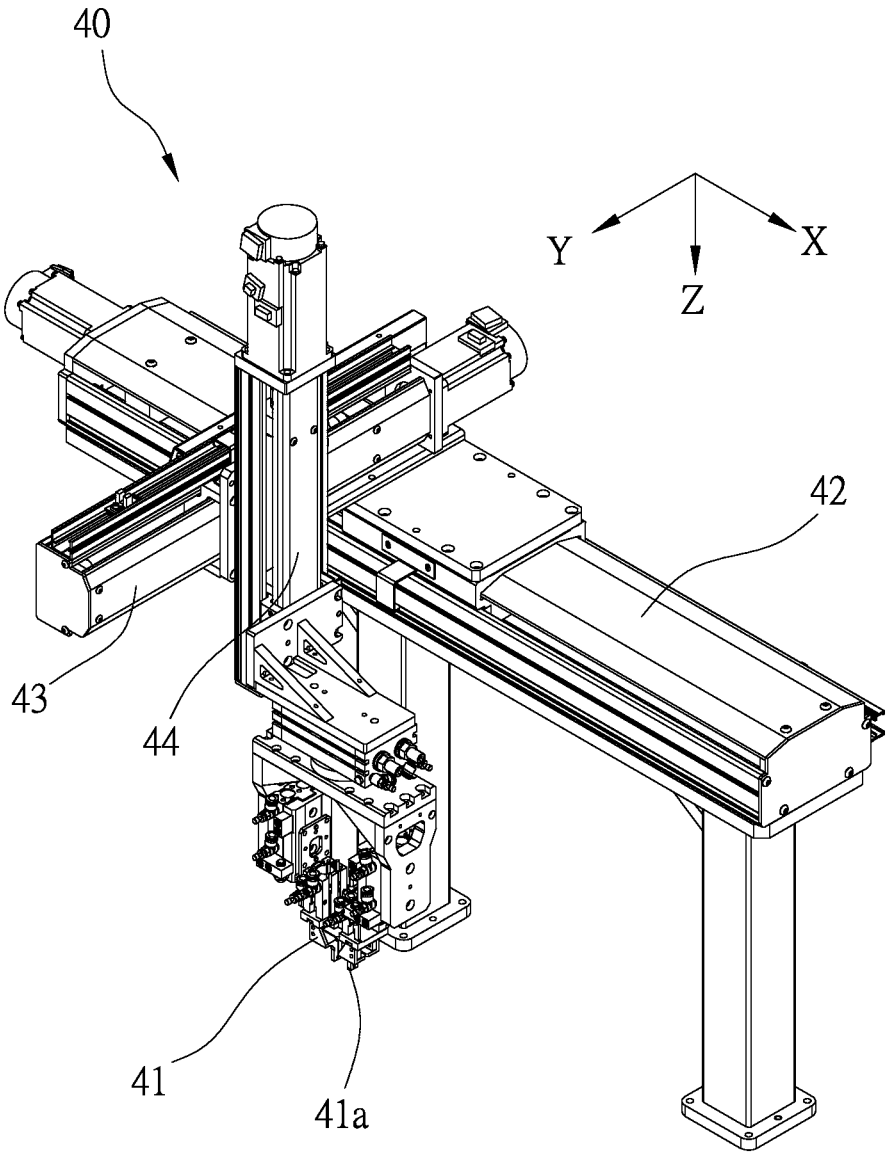
FIG. 5 is a perspective view of the shoelace-running module of the automatic lacing mechanism shown in FIG. 1.

As shown in FIG. 5, the shoelace-running module 40 includes a gripping unit 41, wherein the gripping unit 41 has a claw 41*a* to grip an aglet (not shown) of the shoelace, so that the aglet of the shoelace could travel back and forth in three-dimensional space to complete the lacing. In the current embodiment, the structure to achieve the aforementioned effect includes an X-axis module 42, a Y-axis module 43, and a Z-axis module 44, wherein the Y-axis module 43 is engaged to the X-axis module 42 and is movable in an X-axis direction, the Z-axis module 44 is engaged to the Y-axis module 43 and is movable in a Y-axis direction, and the gripping unit 41 is engaged to the Z-axis module 44 and is movable in a Z-axis direction. Each of the aforementioned modules is composed of a combination of a rail, a sliding seat, and a motor.

Figure 6:
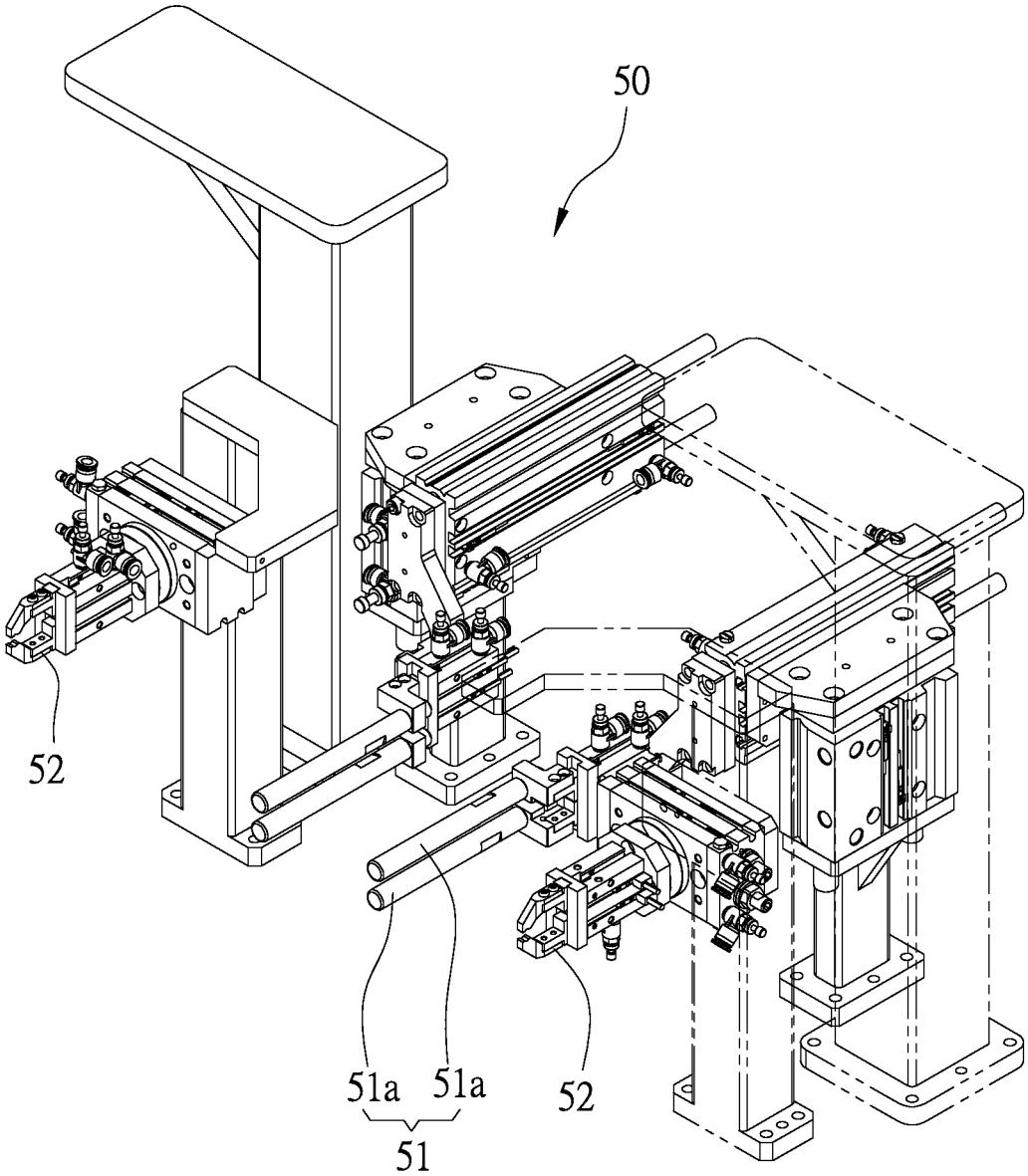
FIG. 6 is a perspective view of the shoelace-arranging module of the automatic lacing mechanism shown in FIG. 1.

As shown in FIG. 6, there are two shoelace-arranging modules 50 respectively located on two sides of the shoelace-running module 40. Each of the shoelace-arranging modules 50 includes a shoelace-arranging clip 51 and a rotation clip 52, wherein the shoelace-arranging clip 51 consists of two round roller rods 51*a* that can be mated to each other or separated from each other. The shoelace passes through the space between the round roller rods 51*a*, and is held when the round roller rods 51*a* are closed. In this way, the shoelace could be steadily pulled and drawn by the gripping unit 41. The rotation clip 52 is adapted to hold the aglet of the shoelace for direction turning, in order to do the subsequent unfinished lacing.

The components of the automatic lacing mechanism 100 of the current embodiment are explained above, and the procedure on how the shoelace is automatically run through the lace eyelets 201 of the shoe pieces 200 is going to be described below. We need to explain first that, since one shoe has two shoe pieces 200, and in order to successfully run the shoelace between the shoe pieces 20, the automatic lacing mechanism 100 of the current embodiment provides a set of clamping module 20 respectively provided on two sides of each of the retaining brackets 14 to fixedly clamp the shoe pieces 200, and the shoe pieces 200 are set in a manner that a proper spacing is maintained therebetween. The controller 60 is adapted to control the clamping module 20, the positioning module 30, the shoelace-running module 40, and the shoelace-arranging module 50 to sequentially perform the lacing based on the arrangement of a program.

Figure 7:
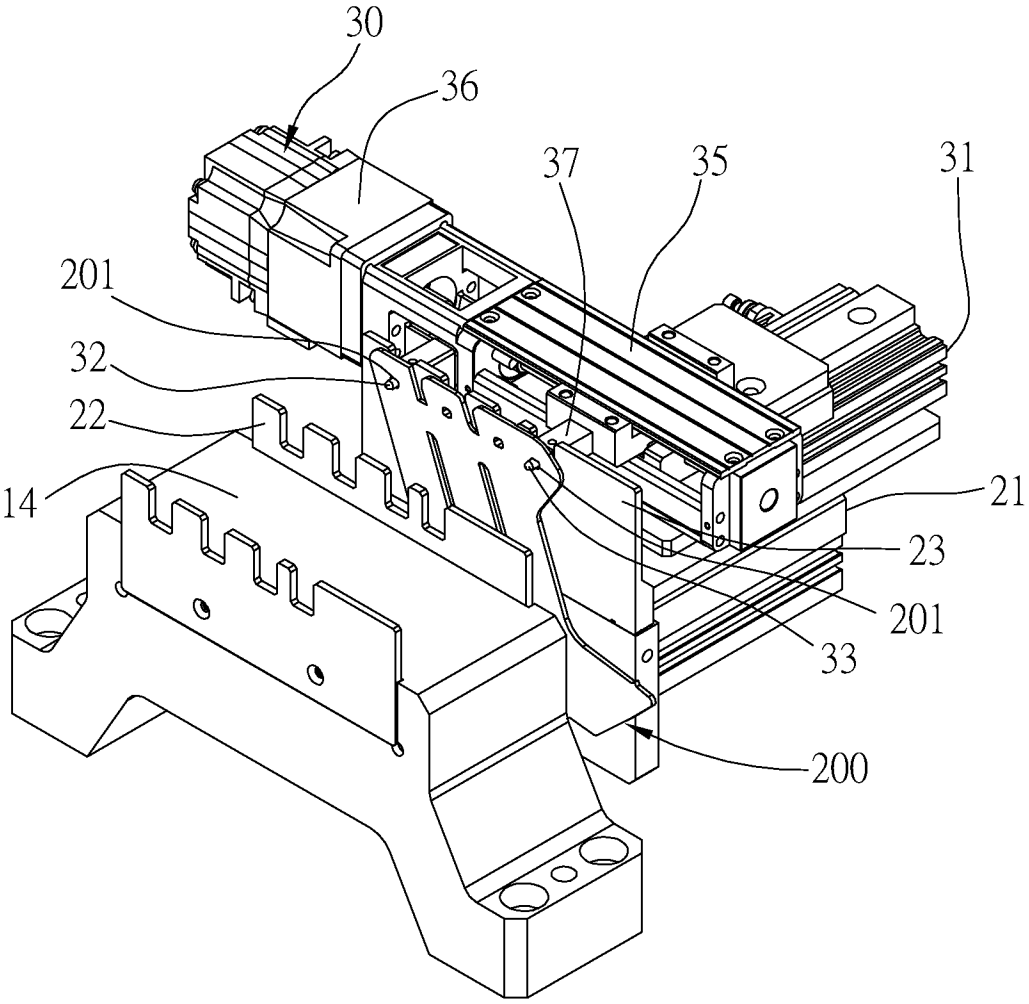
FIG. 7 is a perspective view showing a shoe piece is positioned on the positioning module.
Figure 8:
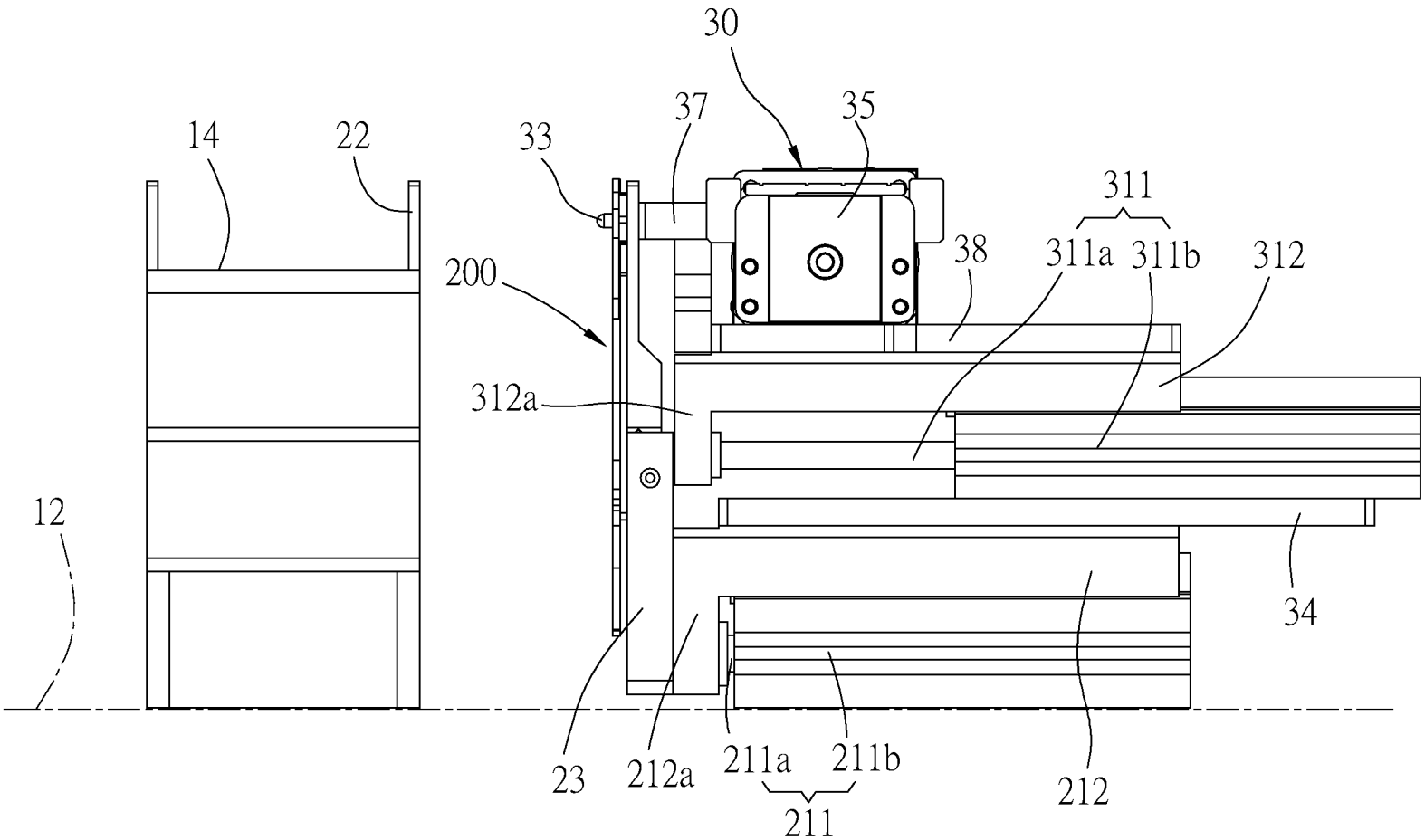
FIG. 8 is a side view of FIG. 7, showing the movable plate of the clamping module is away from the fixed plate.

The illustration shown in FIG. 7 and FIG. 8 expresses the situation when the first retractable rod 311*a* of the first cylinder 311 of the positioning module 30 extends outward, which also urges the first positioning pin 32 and the second positioning pin 33 to stay in a state of passing through the hollow portions 23*a* of the movable plate 23 (referring to FIG. 3) and extending toward the fixed plate 22. After that, the shoe piece 200 is placed between the fixed plate 22 and the movable plate 23 in a manner that two of the lace eyelets 201 align with and fit around the corresponding first positioning pin 32 and second positioning pin 33. At this point, the positioning of the shoe piece 200 is completed. It is worth mentioning that, in the present invention, the distance between the first positioning pin 32 and the second positioning pin 33 can be changed by inputting parameters through the control interface 61 to meet the requirements of the shoe piece of different specifications, wherein the central processing unit would accordingly control the motor 36 to operate, whereby the position of the second positioning pin 33 could be automatically adjusted, and therefore the distance between the positioning pins could be changed for the shoe piece of various specifications. In this way, the efficiency could be improved.

Figure 9:
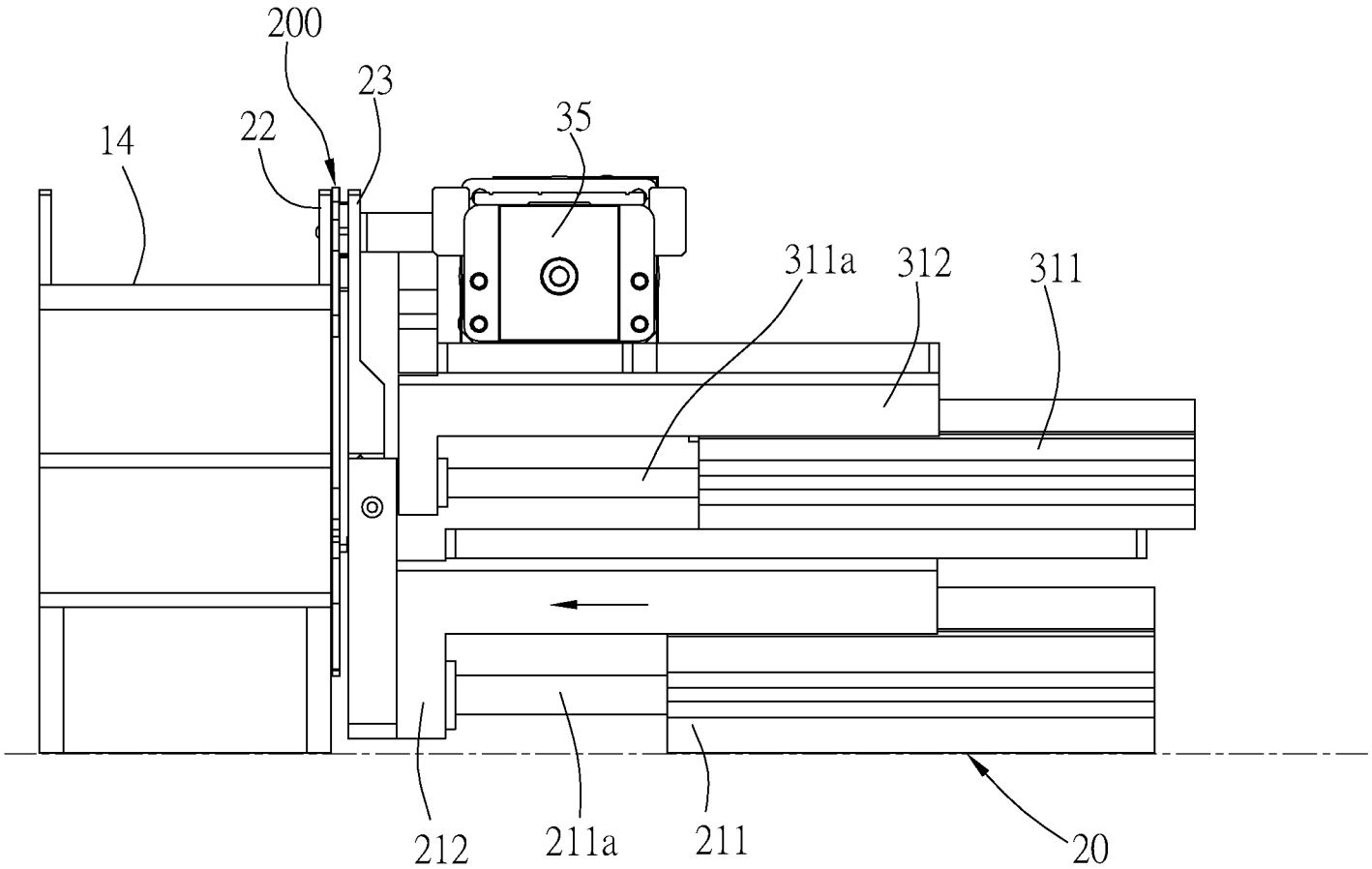
FIG. 9 is similar to FIG. 8, showing the movable plate of the clamping module approaches the fixed plate.

As shown in FIG. 9, the second cylinder 211 of the clamping module 20 is controlled to operate, and the second sliding seat 212 is pushed to move by the outwardly extending second retractable rod 211*a*, so that the movable plate 23 which is engaged on the second sliding seat 212 approaches the fixed plate 22 until the fixed plate 22 and the movable plate 23 fixedly hold the shoe piece 200 together. At this point, the lace eyelets 201 of the secured shoe piece 200 (referring to FIG. 3) happen to align with the hollow portions 22*a*, 23*a*. At the same time, the pressing sheet 22*b* of the fixed plate 22 and the pressing sheet 23*b* of the movable plate 23 press against the shoe piece 200 from opposite directions without covering the lace eyelets 201. In this way, the shoe piece 200 could be held steadily, and not just that, the aglet of the shoelace could aim to and successfully pass through the lace eyelets 201.

Figure 10:
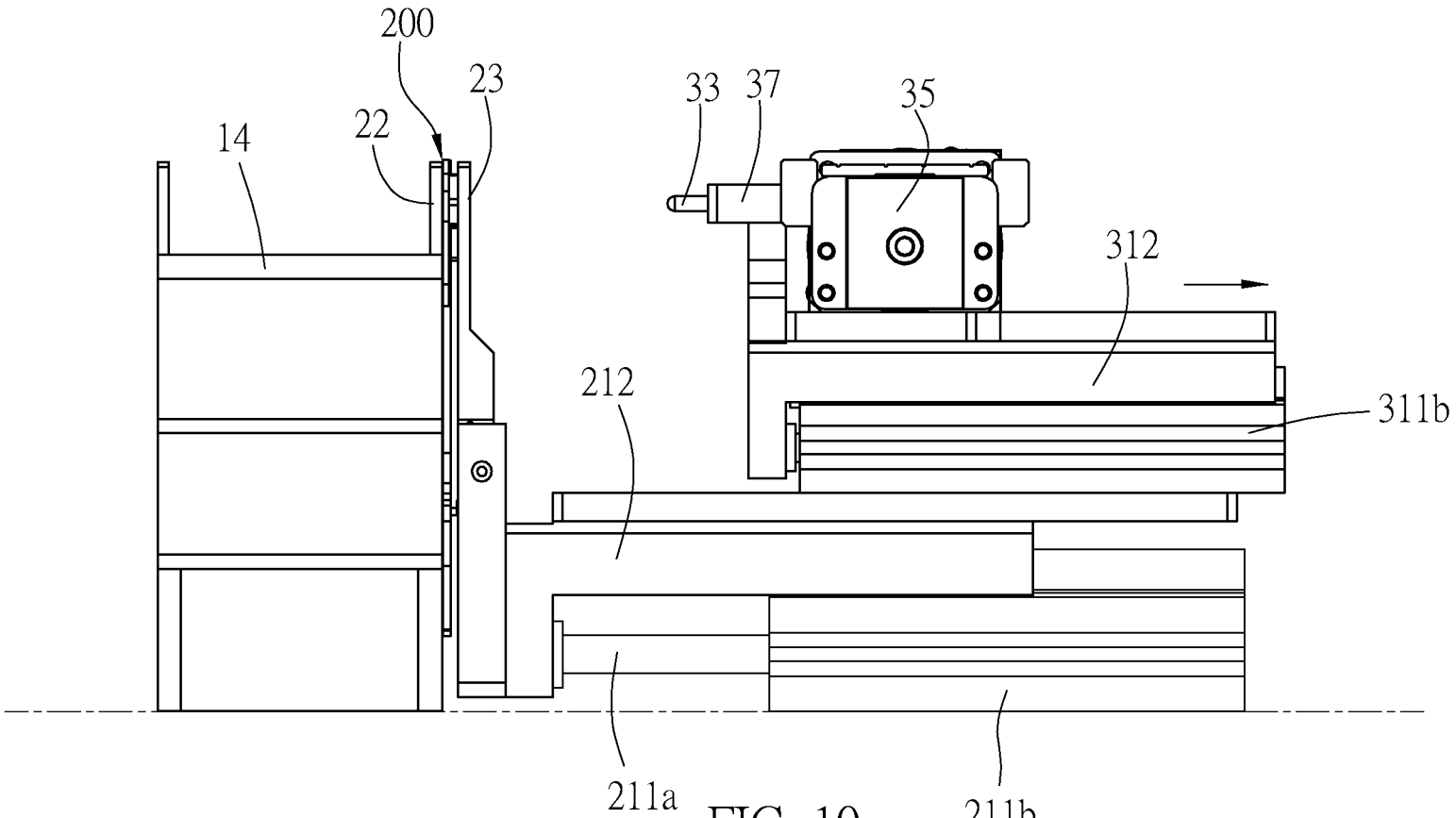
FIG. 10 is similar to FIG. 8, showing the positioning pin of the positioning module exits the lace eyelet of the shoe piece.

As shown in FIG. 10, when the clamping module 20 stops operating, the first retractable rod 311*a* of the first cylinder 311 of the positioning module 30 could be controlled to retreat into the cylinder body 311*b*, wherein the first sliding seat 312 would be moved backward at the same time. As a result, the first positioning pin 32 and the second positioning pin 33 exit the lace eyelets 201 of the shoe piece 200 together. The space made in this movement would be sufficient for the gripping unit 41 of the shoelace-running module 40 to freely draw the shoelace through and between the adjacent shoe pieces. Once the lacing operation is all completed, the controller 60 could be used to control the second retractable rod 211*a* of the second cylinder 211 to retreat into the cylinder body 211*b*, which would also bring the second sliding seat 212 to move backward, so that the movable plate 23 would be away from the fixed plate 22 to release the shoe piece 200. At this point, the shoe piece, which has been laced, could be taken off.

In the aforementioned embodiment, the fixed plate 22 and the movable plate 23 improve the stability of the shoe piece 200 by pressing the pressing sheets 22*b*, 23*b* against the shoe piece 200 in opposite directions. Therefore, the hollow portions of the fixed plate and the movable plate could be made as various specifications with different spacing to adapt the change on the distance between the first positioning pin 32 and the second positioning pin 33. In view of this, it would be preferred to make the fixed plate and the movable plate replaceable. However, since the shoe piece has certain toughness to maintain a standing position, the fixed plate and the movable plate in other embodiments could also have no structures of hollow portions and pressing sheets, as long as the lace eyelets on the upper part of the shoe piece could be ensured uncovered when the shoe piece is fixedly clamped.

It must be pointed out that the embodiments described above are only some preferred embodiments of the present invention. All equivalent structures which employ the concepts disclosed in this specification and the appended claims should fall within the scope of the present invention.

What is claimed is:

1. An automatic lacing mechanism for automatically lacing a shoelace between two shoe pieces, comprising:

a positioning module comprising a first moving unit and two positioning pins, wherein the first moving unit is adapted to move the positioning pins in and out of two lace eyelets on one of the shoe pieces, and a distance between the positioning pins is adjustable;

a clamping module comprising a fixed plate and a movable plate, wherein the movable plate is operable to approach or leave the fixed plate, when the movable plate approaches the fixed plate, the clamping module is adapted to fixedly clamp one of the shoe pieces; when the movable plate is away from the fixed plate, the clamping module is adapted to release said shoe piece; furthermore, the positioning pins of the positioning module exits the lace eyelets when said shoe piece is clamped;

a shoelace-running module adapted to run the shoelace through the lace eyelets of the shoe pieces; and a shoelace-arranging module adapted to change a running direction of the shoelace.

2. The automatic lacing mechanism of claim 1, further comprising a controller, which is adapted to be used to input parameters to automatically adjust the distance between the positioning pins of the positioning module.

3. The automatic lacing mechanism of claim 2, wherein the positioning module comprises a casing, a power source, and a sliding block; the casing is provided with a chute on a lateral side thereof; the power source and the controller are electrically connected; the sliding block is disposed in the casing, and is drivable by the power source to rectilinearly reciprocate; a part of the sliding block passes through the chute and protrudes outside to link one of the positioning pins.

4. The automatic lacing mechanism of claim 3, wherein the first moving unit comprises a first cylinder and a first sliding seat; the first cylinder has a first retractable rod which is movable relative to a cylinder body of the first cylinder; the first sliding seat is movably engaged to an external of the first cylinder; an end of the first retractable rod is connected to the first sliding seat; the casing is engaged onto the first sliding seat; The other one of the positioning pins of the positioning module is fixed at the casing or the first sliding seat.

5. The automatic lacing mechanism of claim 4, wherein the clamping module comprises a second moving unit, which comprises a second cylinder and a second sliding seat; the second cylinder has a second retractable rod which is movable relative to a cylinder body of the second cylinder; the second sliding seat is movably engaged to an external of the second cylinder, and an end of the second sliding seat is connected to the movable plate; an end of the second retractable rod is connected to the second sliding seat; the first cylinder is engaged onto the second sliding seat.

6. The automatic lacing mechanism of claim 1, wherein the fixed plate and the movable plate of the clamping module have a plurality of hollow portions formed on upper parts thereof, and a pressing sheet is formed beside the hollow portions; when said shoe piece is fixedly clamped between the fixed plate and the movable plate, the lace eyelets of said shoe piece are aligned with the hollow portions, and the pressing sheet pushes against said shoe piece without covering the lace eyelets thereof.

7. The automatic lacing mechanism of claim 1, wherein the shoelace-running module comprises an X-axis module, a Y-axis module, a Z-axis module, and a gripping unit; the Y-axis module is engaged to the X-axis module and is movable in an X-axis direction; the Z-axis module is engaged to the Y-axis module and is movable in a Y-axis direction; the gripping unit is engaged to the Z-axis module and is movable in a Z-axis direction; the gripping unit has a claw to grip an aglet of the shoelace.

* * * * *